US006620024B2

(12) United States Patent
Choi

(10) Patent No.: US 6,620,024 B2
(45) Date of Patent: Sep. 16, 2003

(54) COMPUTERIZED TOY

(75) Inventor: Kei Fung Choi, Causeway Bay (HK)

(73) Assignee: Silverlit Toys Manufactory, Ltd., Hong Kong (CN)

( * ) Notice: Subject to any disclaimer, the term of this patent is extended or adjusted under 35 U.S.C. 154(b) by 0 days.

(21) Appl. No.: 09/776,535

(22) Filed: Feb. 2, 2001

(65) Prior Publication Data

US 2001/0049248 A1 Dec. 6, 2001

Related U.S. Application Data

(60) Provisional application No. 60/179,827, filed on Feb. 2, 2000, and provisional application No. 60/183,937, filed on Feb. 22, 2000.

(51) Int. Cl.[7] ..... A63H 33/26

(52) U.S. Cl. ..... 446/485; 446/175; 446/321; 318/568.2; 901/1

(58) Field of Search ..... 446/356, 353, 446/352, 330, 175, 454, 456, 297, 298, 299, 300, 301, 302, 303, 321, 337, 338, 339; 318/568.2, 568.12, 568.1, 569; 901/1, 15

(56) References Cited

U.S. PATENT DOCUMENTS 2,850,839 A * 9/1958 Bogart ..... 446/356
D186,323 S * 10/1959 Kinniburgh ..... D21/611
4,177,602 A * 12/1979 Choi ..... 446/356
4,614,504 A * 9/1986 Yamasaki ..... 446/335
4,923,428 A * 5/1990 Curran ..... 446/175
5,142,803 A * 9/1992 Lang ..... 348/61
5,324,225 A * 6/1994 Satoh et al. ..... 446/175
5,636,994 A * 6/1997 Tong ..... 434/308
5,655,945 A * 8/1997 Jani ..... 446/175
5,697,829 A * 12/1997 Chainani et al. ..... 446/436
5,700,178 A * 12/1997 Cimerman et al. ..... 446/301
5,735,726 A * 4/1998 Cohen ..... 446/175
5,746,602 A * 5/1998 Kikinis ..... 446/298
5,902,166 A * 5/1999 Robb ..... 446/485
5,929,585 A 7/1999 Fujita
D418,551 S * 1/2000 Kageyama et al. ..... 446/369
6,012,961 A * 1/2000 Sharpe, III et al. ..... 446/175
6,048,209 A * 4/2000 Bailey ..... 446/297
6,089,942 A * 7/2000 Chan ..... 446/175
D431,270 S * 9/2000 Kawakita et al. ..... D21/611
6,149,490 A * 11/2000 Hampton et al. ..... 446/298
6,227,931 B1 * 5/2001 Shackelford ..... 446/268
6,253,058 B1 * 6/2001 Murasaki et al. ..... 446/175
6,259,486 B1 7/2001 Mahvi
6,290,566 B1 * 9/2001 Gabai et al. ..... 446/175
6,358,111 B1 3/2002 Fong et al.

* cited by examiner

*Primary Examiner*—Derris H. Banks
*Assistant Examiner*—Urszula M Cegielnik
(74) *Attorney, Agent, or Firm*—Charles Berman; Claude Nassif; Greenberg Traurig, LLP

(57) ABSTRACT

A computerized toy system has a body having the appearance of an animal. The computerized toy system permits the animal to adopt different attitudes and positions, the positions including at least three of a lying attitude, a sitting attitude, a working attitude, a standing attitude and different types of walking attitudes. There are limbs having joints to permit for movement of the toy. There are sufficient in number to permit for a relatively natural and smooth manner of movement representation of the animal. The body construct or skin appearance renders the toy realistic of an animal. The skin appearance may selectively be a fur or plush-type body.

16 Claims, 2 Drawing Sheets

COMPUTERIZED TOY

RELATED APPLICATIONS

The present invention relates to U.S. Provisional Application Ser. No. 60/179,827, filed Feb. 2, 2000, and entitled "Robot Toy System"; and U.S. Provisional Application Ser. No. 60/183,937, filed Feb. 22, 2000, and entitled "Computerized Toy", the contents of which are incorporated by reference herein.

BACKGROUND OF THE INVENTION

This invention relates to a toy computerized system and a control method preferably applied to, for example, an automatically operable toy system.

A different device, namely a robot system is disclosed in U.S. Pat. No. 5,929,585 (Fujita), and the contents of that patent are incorporated herein.

SUMMARY OF THE INVENTION

According to the invention a toy computerized system includes a shell representative of a animal, such as a dog. It is supported by multiple joint-type leg mechanisms serving as legs. The leg mechanisms are connected to the front and rear ends of a frame. A neck head mechanism is set on the front frame of the shell. An actuator provided joint is located at the top end of each leg mechanism. It is connected to the frame. One or more actuator joints are provided to each mechanism to act as an elbow or knee joint.

The head includes a microphone for receiving external sounds and it supplies an output signal to a signal processing circuit. The signal processing circuit supplies angle detection signals of angle detectors arranged on the actuator joints to an analog-to-digital conversion circuit. The analog-to-digital conversion circuit generates angle data corresponding to an angle detection signal and supplies the angle data to a microcomputer serving as control means. The signal processing circuit supplies an output signal from the microphone to the analog-to-digital conversion circuit. The analog-to-digital conversion circuit generates acoustic data corresponding to the intensity of an output signal of the microphone and supplies the acoustic data to the microcomputer.

The actuator joints control objects corresponding to a determined state and their rotational angles for a pulse generation circuit in accordance with an actuator control value or angle data previously stored in the memory. The pulse generation circuit generates a control signal corresponding to the designation and supplies the control signal to the actuator joints to be controlled.

The computerized toy system can select different attitudes or actions. For instance, with an animal character, there is a lying attitude, sitting attitude, working attitude, standing attitude and different types of walking attitude. The microcomputer selects an attitude or action in accordance with a state machine. The state machine represents an attitude or action of the walk robot and has multiple different states corresponding to the different attitudes. The state machine updates the present state to one of these states corresponding to an external sound. The state machine is updated, to make the toy execute any attitude or action. The microcomputer controls the actuator joints to change attitudes to select an attitude corresponding to an updated state.

The invention is further directed to providing a computerized toy which looks realistically and organically like an animal, preferably a dog. The construct of the computerized toy is that of a toy level product incorporating technology applicable to a toy rather than an expensive computerized robot. As such, the toy of the present invention may be useful for children and have a market price of one or a couple hundred dollars as opposed to sophisticated robot devices which may cost several thousand dollars.

Preferably, the toy grade computerized product includes only a microprocessor and sensors, as the controlling electronics, which operates several respective motors. There are a limited number of joints, preferably sixteen, which is sufficient to enable the toy to move in a natural and smooth manner representative of an animal such as a dog. The construct or skin of the toy is formed to be more realistic of a toy rather than a metallic artificial robot. As such, the configuration of the components and the material used can selectively be that which is akin to a toy dog, for instance a fur or plush type body can be applicable to the surface of the toy as seen by a user rather than a metallic artificial robot effect.

Preferably, the toy can recognize sound and the direction of a sound source, and can turn its head relatively sharply in the direction of the sound and walk towards that sound. Similarly, the device can recognize a human voice recorded in its memory and react to that voice. Commands can be sent to the product via a voice without an external controller, or simply by pressing an appropriate button on a controller.

One of the devices with the invention can react with other devices in a communicative kind of manner such that there is a respective interaction between different animals or dogs, as the case may be.

Each one of the computerized pets can be created with its own initial behavior characteristics, namely it can be figuratively born in a particular unique manner. Different instructions to the toy from a user can be made so that the behavior of the toy can progressively change in response to the action from the user.

In yet a further preferred form of the invention, the toy can be edited via an on-line connection with a computer.

The invention covers a computerized toy and method for operating a computerized toy.

The invention is further described with reference to the following detailed description which is material referring to an example animal, namely, a dog character identified as i-Cybie. Other kinds of toys can operate with the robot system. For instance there can be different animals, a cat, a rabbit, animals with two legs, crawling creatures, birds, and reptiles.

DETAILED DESCRIPTION OF THE INVENTION

Figure 1:
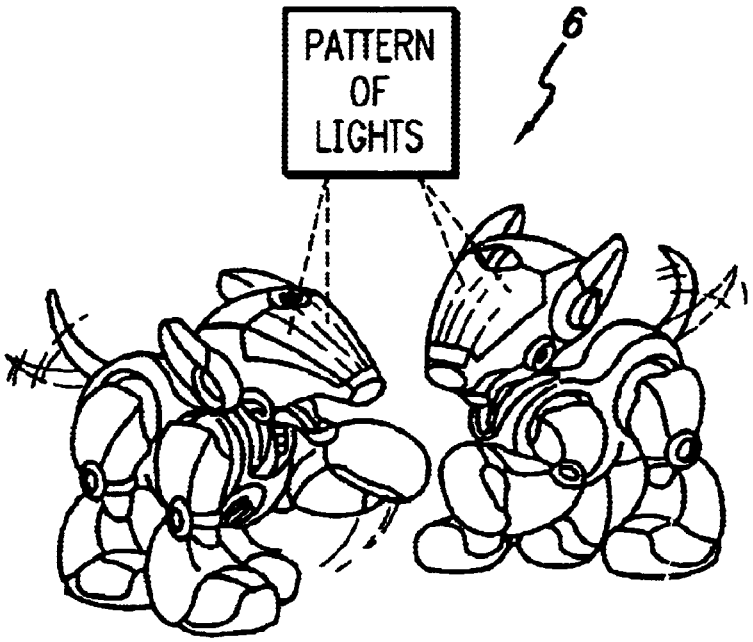
FIG. 1 is a representation of two computerized animals interacting.
Figure 2:
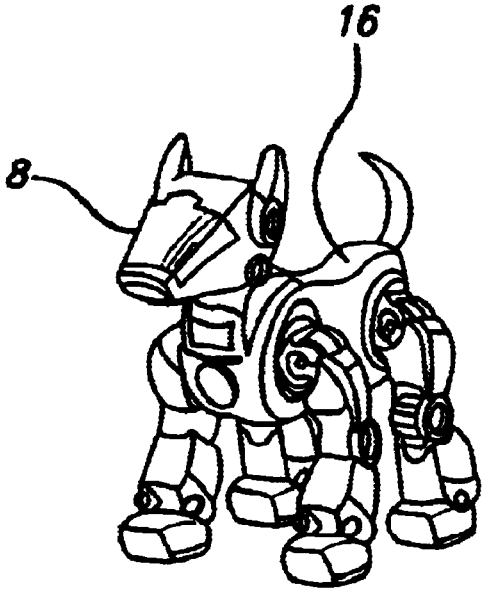
FIG. 2 is a detailed representation of one of the animals showing a representation of a fur-like body.
Figure 3A:
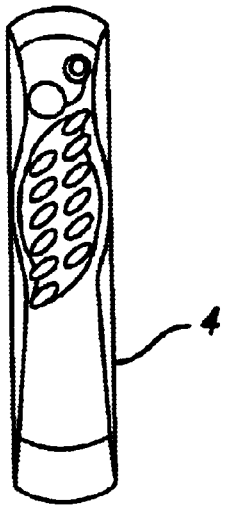
FIG. 3*a* is a representation of the front of a remote controller.
Figure 3B:
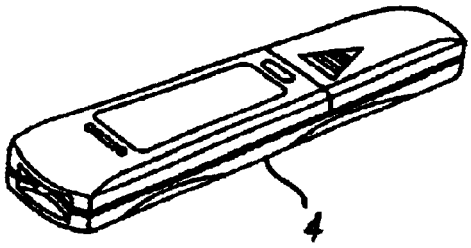
FIG. 3*b* is a representation of a perspective of the rear of the remote controller.
Figure 4:
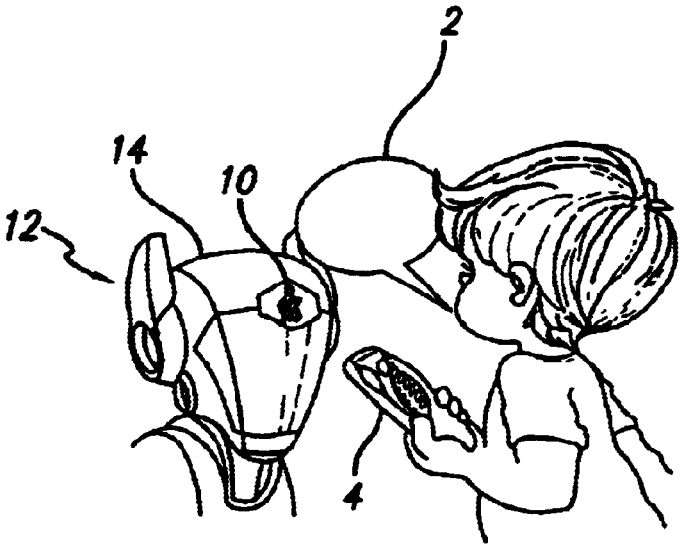
FIG. 4 is a representation of a human interacting with the animal with a remote controller in the hand of the human.

The invention is described with reference to a toy of the invention which the Applicant refers to as I-Cybie. This is representative of one toy, namely a pet dog. The description is set out of issues relating to the pet dog, and what is desirable to have an effective pet dog in keeping with the scope of the present invention.

Not every feature set out in this exemplary embodiment is required in the invented computerized pet toy.

1. First Meets i-Cybie 1.1 Story

I'm i-Cybie, your interactive cyber-pet from a distant world . . . future world far different from any you know. I've been sent to you on a very special mission . . . to live and play among you and become the companion, loving friend and devoted servant I alone can be. After light years of dreams, research and discovery by interplanetary intelligence, I have been instructed to come to you in the form of man's best friend and take my rightful place as a member of your family . . . to give and receive your love and show you my affection by performing tasks and communicating with you in a way that only i-Cybie can.

Pets from your planet find me fascinating because I can do things—and perform tricks that they could never do. I understand your language, recognize your voice and will always obey your commands, especially when you use my special Cybie remote control to activate my intelligence and tell me how to please you.

1.2. Let's Introduce Cybie

Brief introduction of i-Cybie, about its personality, characteristics, ability, emotion, instincts, features, and communication ability.

1.2.1 Sense of Sight (Obstacle Detector)

i-Cybie can detect obstacles ahead and avoids hitting on it.

1.2.2 Sense of Audition (Sound Discretion Sensor)

It detects owner's voice 2 and turns itself to that direction.

1.2.3 Responses to Light (CDS Sensor)

When the ambient get dim or dark, it will take a nap.

1.2.4 Energy Monitor System i-Cybie will slow down its activities or lying down when its power below a certain level.

1.2.5 Sense of Touch

Player can pat on its head or back to stop its motion or change its behavior.

1.2.6 Automatic Get Up i-Cybie knows when it is fallen down and gets up automatically.

1.2.7 IR Remote Commander

Player can use the handheld remote commander 4 to direct i-Cybie's movement.

1.2.8 Voice Recognition System

Player can teach i-Cybie verbal signals 2 and command it by voice later.

1.2.9 IR Communication Link

When two i-Cybies met 6, they will communication through body language and sounds.

1.2.10 Full Motion Actions 16 built-in motors make i-Cybie performs actions freely from walk to sit, give hand and lying down, etc.

1.2.11 Friendliness i-Cybie will show its friendliness when people put hand near it nose by sniffing actions.

1.2.12 Express Feeling i-Cybie always use sound effects, light pattern on its eyes 8, and body language to express its feeling.

1.2.13 Distinctive Character's Behavior

Each i-Cybie has its own character and behavior on initial state that makes it perform some special actions (for instance 3 different types) frequently. Its behavior may change as player plays with it for some times.

1.2.14 Instant Get REST/STOP Button

Player can make i-Cybie enter Get Rest pose or freeze all motion instantly by pressing on the keys on the back.

1.2.15 Automatic Sleep Mode (Energy Saving System)

i-Cybie will automatically enter Sleep Mode if it is left unattended for a period of time to preserve energy.

1.2.16 Artificial Intelligent Unit

The internal Artificial Intelligent Unit controls all the performances of i-Cybie. It always give you surprise that every time the player play with it.

1.2.17 Computer Link Toolkit

An expansion kit for computer linkage, which controls and program i-Cybie's detail actions and will launch soon.

The different parts of i-Cybie include:

1. Eye lams
2. CDS receiver/Infrared receiver
3. Speaker
4. Led lamp/Microphone 10
5. Sound Direction sensor
6. Instant REST/STOP
7. Tail
8. Non-slippery sole
9. Reset Button
10. Backup batteries compartment (3x1.5v LR44)
11. Touch sensor 12
12. Main Batteries compartment (9.6v Ni-Ca Rechargeable Battery)
13. Mouth Remote Controller 14

1. Record button
2. Recess button
3. Operation commands
4. Infrared emitter
5. Indication
6. Batteries compartment (2×1.5v~'AA", Battery)

Transformer and Battery Pack

1. Battery Pack
2. Plugs
3. Transformer

2. Getting Started 2.1 Preparation

The i-Cybie is powered by two different types of battery:

One 9.6V Ni—Ca rechargeable battery pack.

Three LR44 button cells

The remote control cells

Two 1.5V "AAA" alkaline batteries 2.1.2 Battery Installation—Body

Remove the battery cover at the bottom as indicated.

Install battery by inserting the battery pack inside the battery compartment at the body.

Connecting the plug from inside the battery compartment to the plug of the battery pack.

Put the battery cover back in position.

2.1.3 Battery Installation—Head

Remove the battery cover at the rear head by using a screwdriver. (Turn counter-clockwise)

Then install three 1.5V LR44 button cells as indicated with polarity as shown inside battery compartment.

It is recommended to discard the batteries and replace with new ones tri-monthly.

Note: All data will be erased if both batteries from Body and Head are removed simultaneously 2.1.4 Remote Controller 4

Slide the battery cover out as shown.

Install two 1.5V ~AAA" alkaline batteries as indicated with polarity as shown inside battery compartment.

Put the battery cover back in position.

When the Controller no longer operates i-Cybie or pressed without a "beep" sound, replace new batteries.

When the main batteries of Body run out, i-Cybie will request to be charged by flashing its eyes in green and red alternatively.

Do not remove battery pack and batteries from i-Cybie while it is in movement. Doing so may cause damage.

If battery discharges more quickly than usual, it may have reached to the end of its lifetime. Replace with a new one.

Do not leave a fully charged battery pack to be charged continuously. Doing so may damage the battery.

Be sure not to connect the battery pack or the transformer to any unauthorized accessories, which is not come with this package. Doing so may cause damage.

Remove batteries if it is not being used for a relatively long period of time.

Pick up by the whole body, but not by its extremities, such as ears, head, legs or tail. Do not swing or twist them.

2.2 Playing for the First Time 2.2.1 Environment

After installing all the batteries required as instructed. Select an ideal environment as suggested below for i-Cybie to start its first step.

Do not let i-Cybie walking in outdoors, doing so may affect its performance and allow foreign matters to get into it. This may cause damage.

Do not walk i-Cybie in wet and coarse surfaces; or over thick carpet. Run only on flat, smooth and dry surfaces.

Also, do not subject i-Cybie to vibration, or place it in an inclined position or in a place where there is possible risk for i-Cybie to fall.

2.2.2 First Step

Press the rectangular button on its back, then enjoy watching i-Cybie Learning to walk on its own without human controlled. It is a good chance for you to know better of i-Cybie by understanding its natural behavior and characteristic, by watching and observation. It takes a while for i-Cybie to get use to walk smoothly at the very first time. After finishing its quick learning lesson, it will stop to wait for your further instruction.

When i-Cybie falls, It will try to get up by itself. When it is not able to stand up, give it a hand to help i-Cybie to straighten itself up. For emergency stop i-Cybie from doing any kind, press the PAUSE button on the back once, which function as instant stop while it is in motion. Press once again to reactivate i-Cybie's motion. To put i-Cybie in sleep, press the REST button on its back once, it will then prepare itself to enter Sleep Mode by changing its pose to lie down first, which it still stay awake. After a short period of time not being interrupted, it will enter Sleep Mode. Wake i-Cybie up by press the same button once again.

2.2.3 Particular Performance

Besides just watching i-Cybie walking free around, you can ask i-Cybie to do some particular performance by simply using the remote controller 4. You can control how i-Cybie moves, react, or deliberately stop its activity.

2.2.4 Particular Actions

| | | |
|---|---|---|
| 1. Greeting | 2. Come over | 3. Roll |
| 4. Stand back | 5. Hand hand | 6. Sit |
| 7. After bath | 8. Bark | 9. Pause |
| 10. Dance | 11. Wave hands | 12. Shaking |

2.2.5 Recording Command (Voice Recognition)

You are allowed to record your own voice command 2 by using the remote controller 4. Every time when you give your voice command to instruct i-Cybie to perform particular action that you want, it will recognize and perform the requested actions immediately.

Note:

Every time when you start a new voice recording, it will automatically override and replace the previous record.

It is recommended to select a quiet environment to ensure the accuracy of the recording process Each Voice Command should not exceed 1.5 seconds.

It is suggested that each Voice Command should distinctive from others. Example:

Suggested: "Sit down"; "i-Cybie, come here"

Not suggested:"Sit"; "Come"

2.2.6 Performing Voice Command

If the voice recording process has done, you are then allowed to give your own voice command to i-Cybie at any time without using the remote controller. i-Cybie will react to your given command instantly by performing the action you instructed immediately and precisely.

To ensure i-Cybie can hear you, giving your voice command in a quiet place and don't let i-Cybie getting its ears covered under any circumstances.

2.2.7 Inter-communication

Every i-Cybie has the gifted capability to communicate with humans and other i-Cybies of its kind. When two i-Cybies 6 have chance to get together, they, have their own particular way of communication among same species. Enjoy watching this special moment and get better to know of its behaviors 3. Better Understanding To get better communicating and understanding of i-Cybie, it is essential to aware of its emotions, instincts and characteristics. Its emotions, instincts and characteristics will help to determine how i-Cybie interacts with humans and its environment.

3.1 Emotions

Emotions are shown through many ways, a variation in eye lights 8 will surely give you obvious indication.

Most of the time, you may find that some eye signals will just simply indicate i-Cybie is on operation and function normally, which are related nothing to emotions. However, some eye signals are meaningful which indicates the current mood and changes in emotional state of i-Cybie.

| Emotion | Causes | Symptoms |
|---|---|---|
| Happy | Being petted or getting feed. | Both eyes flash in GREEN continuously for 3 seconds. |
| Naughty | When performing its natural characteristics. | Both eyes flash in RED continuously for 3 seconds. |
| Bored | Being ignored or left alone, and going to get rest. | Both eyes flash in RED once in every 3 seconds. |
| Dutiful | Aware of signals received, and get ready to react. | Both eyes flash in RED simultaneously for 3 times. |

3.2 Instincts i-Cybie has 6 key instincts which strongly contribute to motives of its actions. In response to its every individual instinct, it behaves in a manner that will satisfy its particular desires.

3.2.1 Love i-Cybie is naturally inclined to interact with people who will give it care and love. To show your caress, just simply petting its head. The more you pet its head, the happier it will become. In return, i-Cybie will perform particular reactions to show its appreciation, happiness love in return.

3.2.2 Search i-Cybie has an instinct to detect obstacles ahead so as to avoid unnecessary bumping into obstacle and search its way moving around in any environment. Every time when it detects an obstacle ahead in a near distance, it will react to it by turning around or changing its direction to get rid of the obstacle eventually.

3.2.3 Eat i-Cybie loves to eat. Whatever objects you put close to its mouth, they will all be mistaken as food. Then i-Cybie will open its mouth widely and start chewing the object simultaneously.

3.2.4 Hungry i-Cybie lives its life by constantly charging battery to sustain its life. Every time after playing with i-Cybie, connect its battery pack to the transformer for charging. Low battery power does imply that i-Cybie is hungry and has no energy to perform any movement until it get feed and regain its full energy.

3.2.5 Bark

Barking is one of the key instincts of i-Cybie, in order to communicate with human or its kind and voice out its wants. Usually, i-Cybie barks to request feeding when it feels hungry, or barks to ask for your assistance and help. Therefore, when you hear its barking, remember to check if there is something wrong with i-Cybie.

3.2.6 Rest

Sometimes, i-Cybie will nap or sleep under the following conditions:

It feels bored by being ignored or left alone for 1–2 minutes.

Being kept in the dark for 1–2 minutes.

Being lift up for certain period of time.

Hungry when battery power is low.

During the resting period, its eyes will turn into red and flash once in every 3 seconds as indication of going to sleep. Prolonged situations as above will finally put i-Cybie into sleep. Also, you can deliberately to put i-Cybie into sleep in a faster way by pressing the REST button once on its back.

To wake it up from asleep, press the REST/STOP button on its back once.

3.3 Characteristic

Every i-Cybie is born to have its own character, which may have slightly difference from one to another.

Some of them bark frequently.

Some like to pee more often.

Some love to do swim exercise a lot.

Every time when i-Cybie started to generate any of those characteristics, its eyes will flash in red continuously for 3 seconds. To change or correct these behaviors, you can give immediate response to i-Cybie by petting its head while it is at the time of performing those behaviors. When keep doing this after a while, you will discover that i-Cybie is gradually cutting those characteristics out.

4. Interacting with i-Cybie

Player can use various methods to interact with 1-Cybie. On the other hand, i-Cybie will express itself to us through Sound effects, Light pattern on eyes, and Body language.

4.1 Via Remote Controller 4

Player can use various methods to interact with i-Cybie. On the other hand, i-Cybie will express itself to us through Sound effects, Light pattern on eyes, and Body language.

4.2 Via Voice Command (or Verbal Signal) 2 i-Cybie will perform a preset action when it receive a recognized user defined Voice Command (or Verbal Signal).

4.3 Via Sound Effects i-Cybie expresses itself by making some sound effects from time to time during its own activities, interacts with you or another i-Cybie.

4.4 Via Body Language

Body Language is an important key for, i-Cybie to express itself. You will learn what i-Cybie want by observing its different posture after you stay with it for some times.

4.5 Via Eyes Light Pattern

Each i-Cybie have a pair of Red and Green LED on its eyes' position 8. It use different blinking pattern to represents different meanings, or in some cases, it responses to your input signals with its eyes' blink pattern.

4.6 Via Audition i-Cybie can detects the source direction of sound or voice. You can call it and it knows where you are.

4.7 Via Touch i-Cybie love people touch on its head. Pat on its head 14 frequently can make it feel happy and may alter its character behavior. On the other hand, pat on its back 16 will make it stop motion instantly.

5. After Playing with i-Cybie

If you desire not to play with i-Cybie for some time, do the followings to ensure i-Cybie can keep in good condition.

5.1 Get Rest

When you are not playing with i-Cybie for a few hours, set it to Sleep mode by pressing the REST key on its back briefly or turn off the room lights. i-Cybie will lie down and enter Sleep mode after several seconds.

5.2 Remove Battery

When you are going out for long period and sure not play with i-Cybie shortly, follow the steps below to remove the battery pack.

Press the PAUSE button on its back to freeze its motion

Open the battery door and remove the battery pack

Note that the backup batteries on its head must keep installed to conserve data of behavior status and preset Voice Command. It is saver to keep them there as long as they are exhausted and require replacement.

5.3 Changing Battery

In normal conditions, a fully charged battery pack can continuously operates for 4 hours. Charge the battery regularly (for example before you go to bed) can keep i-Cybie always operate in good condition.

Conclusion

Although the invention has been described with reference to a computerized toy system where the body has the appearance of an animal, mainly a pet dog, it is clear that other different computerized toy systems are possible. Instead of the toy dog, other kind of animal creatures or human representative dolls can be used. Ideally, the computerized toy is created with a construct and skin appearance rendering the toy realistic of the animal or human which is represented. For instance, in the situation where the animal is a dog, the outer appearance can be given that of a fur or plush-type body.

To render the toy suitable for a toy application rather than a super sophisticated application, a relatively limited number of joints and computerized means are provided. Ideally, there are about 16 joints and 16 computerized means for the toy. In other situations there could be less or more. For instance, 8–24 kinds of joints or computerized means. Computerized means would include a suitable microprocessor and motorized means operable with each of the joints to permit the desired movement. Other computerized means within the toy permit for reaction to hearing and other features of the toys as indicated. Suitable miniature motorized systems and microprocessors can be used to operate with the joints. The joints can, for instance be on the tail, the neck, the legs, feet and different body parts of the toy. Suitable gearing can be used between the motors to effect the movements of the toy as desirable. Likewise, the responsive features of the toy can be responsive to the remote control or push button structures which can be built under the toy. Likewise, the computer link can be connected to the toy either hardwired or wirelessly so that a separate PC, computer or the like can be used to reprogram the toy according to the requisite requirements of the user.

The foregoing description of the preferred embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A computerized toy system comprising:

a body having the appearance of an animal, the body of the animal including joints for permitting the animal to adopt different attitudes and positions, the positions including at least three of a lying attitude, a sitting attitude, a working attitude, a standing attitude and different types of walking attitudes;

a system for encoding emotional moods in the animal, said emotional moods being displayed through a pattern of lights; and means for having the toy animal encode and decode emotional moods and wherein said emotional moods are communicated by different flashing light patterns selectively relative to a second computerized toy selectively of a similar nature to the first toy whereby the toy is capable of communicating that particular emotion.

2. A toy as claimed in claim 1 including at least 16 joints, and 16 computerized means, a computerized means being for operating each respective joint.

3. A toy as claimed in claim 1 including no more than 16 joints, and no more than 16 computerized means, a computerized means being for operating each respective joint.

4. A toy as claimed in claim 1 including sound recognition means and means for having the body respond by movement in a direction of the sound source, and additionally having the animal respond with sound representative of the species.

5. A toy as claimed in claim 4 including means for turning the head of an animal in the direction of the source of sound and means for having the body move relative to a physical environment on which it rests in the direction of the sound.

6. A toy as claimed in claim 5 including means in the body for recognizing a human voice and being reactive to the human voice.

7. A toy as claimed in claim 6 including means for submitting commands to the body via voice and for the body to respond to the voice control and selectively including means operable by a button in a controller for operating the body.

8. A toy as claimed in claim 1 wherein the toy is programmed to have a set of initial behavior characteristics, and wherein the behavior characteristics are relatively uniquely set for a particular toy.

9. A toy as claimed in claim 8 including means for changing behavior characteristics of the toy by interaction with the user.

10. A toy as claimed in claim 9 wherein the behavior characteristics of the toy are editable via an online connection with a computer.

11. A toy as claimed in claim 1 further comprising at least one touch sensor to permit the body to respond through at least one of the different attitudes.

12. A computerized toy system comprising:

a body having the appearance of an animal;

the body of the animal including joints for permitting the animal to adopt different attitudes and positions, the positions including at least three of a lying attitude, a sitting altitude, a working attitude, a standing attitude and different types of walking attitudes;

a system for encoding emotional moods in the animal, said emotional moods being displayed through a pattern of lights;

at least one touch sensor to permit the body to respond through at least one of the different attitudes; and means for having the toy animal encode and decode emotional moods, wherein said emotional moods are communicated by different flashing light patterns respectively relative to a second computerized toy selectively of a similar nature to the first toy whereby the toy is capable of communicating that particular emotion.

13. A computerized toy system comprising:

a body having the appearance of an animal;

the body of the animal including joints for permitting the animal to adopt different attitudes and positions, the positions including at least three of a lying attitude, a sitting attitude, a working attitude, a standing attitude and different types of walking attitudes;

computer programmable means on the toy for editing the different attributes via an online connection with a computer;

a system for encoding emotional moods in the animal, said emotional moods being displayed through a pattern of lights;

means for having the toy animal encode and decode emotional moods, wherein said emotional moods are communicated by different flashing light patterns respectively relative to a second computerized toy selectively of a similar nature to the first toy whereby the toy is capable of communicating that particular emotion, sound recognition means to have the body of the animal respond by movement in a direction of the sound source; and means for mining the head of an animal in the direction of the source of sound and means for having the body move relative to a physical environment on which it rests in the direction of the sound.

14. A toy as claimed in claim 13 further comprising at least one touch sensor to permit the body to respond through at least one of the different attitudes.

15. A toy as claimed in claim 13 wherein the toy is programmed to have a set of initial behavior characteristics, and wherein the behavior characteristics are relatively uniquely set for a particular toy.

16. A toy as claimed in claim 13 further comprising at least one touch sensor to permit the body to respond through at least one of the different attitudes.

* * * * *